US005398701A

United States Patent [19]

Neumann et al.

[11] Patent Number: 5,398,701

[45] Date of Patent: Mar. 21, 1995

[54] DEVICE FOR FILLING CIGARETTE TUBES

[75] Inventors: Manfred Neumann; Josef Lier, both of Radevormwald; Wolfgang Rosner, Reichshof-Eckenhagen, all of Germany

[73] Assignee: Gizeh-Werk GmbH, Bergneustadt, Germany

[21] Appl. No.: 949,803

[22] PCT Filed: Mar. 30, 1992

[86] PCT No.: PCT/DE92/00261

§ 371 Date: Apr. 8, 1993

§ 102(e) Date: Apr. 8, 1993

[87] PCT Pub. No.: WO92/17078

PCT Pub. Date: Oct. 15, 1992

[30] Foreign Application Priority Data

Apr. 4, 1991 [DE] Germany ..... 41 10 830.2

[51] Int. Cl.[6] ..... A24C 5/00; A24C 5/06; A24F 47/00

[52] U.S. Cl. ..... 131/70; 131/72

[58] Field of Search ..... 131/70–72

[56] References Cited

U.S. PATENT DOCUMENTS

| | | | |
|---|---|---|---|
| 3,688,777 | 9/1972 | Kastner . | |
| 3,699,975 | 10/1972 | Saraber . | |
| 3,741,220 | 6/1973 | Meinunger . | |
| 3,783,882 | 1/1974 | Messner et al. | 131/70 |
| 4,249,546 | 2/1981 | Heil et al. . | |
| 5,088,506 | 2/1992 | Kastner | 131/70 |

FOREIGN PATENT DOCUMENTS

| | | |
|---|---|---|
| 401608 | 9/1909 | France . |
| 71.03964 | 5/1971 | France . |
| 79 16207 | 6/1979 | France . |
| 1945498 | 9/1969 | Germany . |
| 3706504A1 | 9/1988 | Germany . |
| 4110830C1 | 5/1992 | Germany . |

*Primary Examiner*—Jennifer Bahr
*Attorney, Agent, or Firm*—Louis Weinstein

[57] ABSTRACT

A device for filling prefabricated cigarette tubes, having a housing (1), a tobacco chamber (17), a trough-shaped tobacco holder (7), a compression bar (23), a stop (31) for one end of the plug of tobacco, a finger or bushing (14) on which one end of a cigarette tube can be placed and a sliding cover (11). The length of the plug of tobacco formed can be adjusted to fit cigarette tubes of different lengths by adjusting the length of the tobacco chamber (17) and the length of the compression bar (23). The invention does this by virtue of the fact that the stop (31) defining one end of the tobacco chamber is adjustable in a direction parallel to the longitudinal axis of the tobacco holder (7) and that at least two movable sections (41, 42, 43) of the compression bar, each of different length and each capable of acting as an extension to a stationary part (30) of the bar, are mounted on a rotatable component (40) whose axis of rotation (45) is parallel to the surface (44) of the compression bar.

17 Claims, 4 Drawing Sheets

DEVICE FOR FILLING CIGARETTE TUBES

FIELD OF THE INVENTION

The invention pertains to a device for the filling of cigarette tubes of different lengths or partially filling a cigarette tube by an adjustable amount wherein the length of a tobacco chamber for forming a tobacco strand and the length of a cooperating compression bar are easily adjusted without the need for adding and/or removing parts and without the need for a tool.

STATE OF THE ART

Hand-operated devices of various designs for filling prefabricated cigarette tubes are known. In an advantageous design of a device of this type (West German Patent No. 1,945,498), a slide can be moved back and forth in a housing, which has a fixed stop for the tobacco strand and in which a tobacco holder in the form of a trough-like guide tongue is provided. The slide is provided with a bushing, onto which a cigarette tube can be placed, and with a clamping device for selectively clamping the tube. In the area between its ends, the slide has an elongated recess, completely open from top to bottom, which forms a tobacco chamber. When the slide is in its starting position, which allows the tobacco to be loaded, the chamber is located directly above the guide tongue. A pressure plate or a cover serving as a pressure plate is attached to the slide in such a way that it is able to pivot, as a result of which the part of the pressure plate which, together with the chamber, forms the tobacco strand can be moved into the tobacco chamber formed by the recess. A device such as this is simple in design and simple to operate. The pressure plate or cover can also be used to actuate the clamping device for the cigarette tube. When the device is actuated, the guide tongue does not leave the housing, so that there is no danger of injury.

In another known device for filling cigarette tubes (West German Offenlegungsschrift No. 3,706,504), a tobacco compression chamber is provided in a housing, to which a tubular socket is also attached, upon which the cigarette tube can be placed. A compression bar, which can be moved into the tobacco compression chamber, and a spoon forming a tobacco holder are located on an ejector slide. To enable use of this filling device to produce so-called "king-size" cigarettes as well as so-called "regular" cigarettes, it is proposed that the compression bar be designed in several parts, so that it can be adapted to various predetermined compression chamber lengths by the removal or addition of one or more extension pieces. The compression chamber must also be adjustable in its length by the installation of various filler pieces. To make the device ready for a different format, first a filler piece, which is screwed to the housing and is thus detachable, is removed. Then the compression bar is extended by attaching an extension piece, which is screwed on by means of a screw which passes longitudinally through the compression bar. In a device such as this, the changeover to a different format requires several assembly steps and the use of a tool.

BRIEF DESCRIPTION OF THE INVENTION

The object of the invention is to create a hand-operated device for the filling of cigarette tubes of different lengths or which can be adapted to various lengths of the space to be filled in the cigarette tubes without the need to remove certain parts and to attach other parts. The goal of the invention is also to arrive at an advantageous design of the overall device with respect to its details. Additional problems which the invention deals with in conjunction with the objective described above can be derived from the associated explanation of the solution presented herein.

In a device of the type generally indicated, the invention provides a stop which can be shifted in the longitudinal direction of the tobacco holder and in that at least two extension sections of a compression bar, which sections are of different lengths, are mounted on a rotatable component, the rotational axis of which is parallel to the compression surface of the compression bar, each of the two sections selectively serving as extensions of a stationary part of the compression bar which is stationary with respect to the aforementioned rotatable component.

By shifting the stop defining one end of the tobacco strand, the length of the strand can be easily increased or decreased in accordance with the length of the space to be filled in the cigarette tube in question. The adjusting motion of the stop is advantageously a translational displacement along or in a guide. The length of the compression bar can be adjusted just as easily by turning the rotatable component, without the need for a tool to accomplish the changeover and without the need to remove and/or add any parts.

Advantageous, predetermined latching positions are provided for the adjustable stop, the number of these positions corresponding in particular to the number of different lengths of the space to be filled, for which the device is intended to be used. Several ways in which the device can be locked temporarily in the individual latching positions will be described.

It is advantageous for at least one projection or the like to be provided on the stop or on a part connected thereto; this projection can be engaged in one of at least two recesses on the part which is stationary relative to the stop, these recesses being spaced from each other in the direction in which the stop is adjusted. In a special design, a part connected to the stop can be designed as an elastic catch or as a pivoting catch. The latter can also latch in something itself, at least in the working position.

It is also advantageous to provide preset latching positions for the rotatable component; in each of these positions, a section of the compression bar on the rotatable component extends the stationary part of the compression bar. In particular, the rotatable component can be moved axially a short distance against the force of a compression spring and thus switched from one latching position to another. Projections and recesses, ball catches, and the like, can be used as latching elements.

In an advantageous embodiment of the device, the stop on the housing can be slid relative to the housing and relative to a tobacco holder attached to the housing, this holder taking the form of, for example, a tongue or the like.

In an advantageous embodiment the rotatable component and the stationary part of the compression bar are located on a cover, which is pivotally attached to a slide, which slide also carries the bushing.

The device can be provided with an adjustable boundary part for the rear of the tobacco chamber. Thus, an additional degree of enclosure is obtained in the area above the stop. It is advisable to provide predetermined latching positions for this boundary part, especially in such a way that there is agreement between these positions and the corresponding latching positions of the stop.

It is advantageous to provide the boundary part or a part attached thereto with at least one projection or the like, which can latch into one of at least two recesses in the part which is stationary relative to the boundary part, these recesses being spaced a certain distance away from each other in the adjusting direction of the boundary part. In a special embodiment, a part connected to the boundary part can be designed as an elastic catch or as a pivoting catch. The catch can also latch into something itself, at least in the working position.

In an advantageous embodiment of the device, the boundary part is located on the slide.

Additional objects, details, features, and advantages of the invention can be derived from the following explanation of exemplary embodiments, from the associated drawing, and from the claims.

DETAILED DESCRIPTION OF THE INVENTION AND PREFERRED EMBODIMENTS THEREOF

Figure 1:
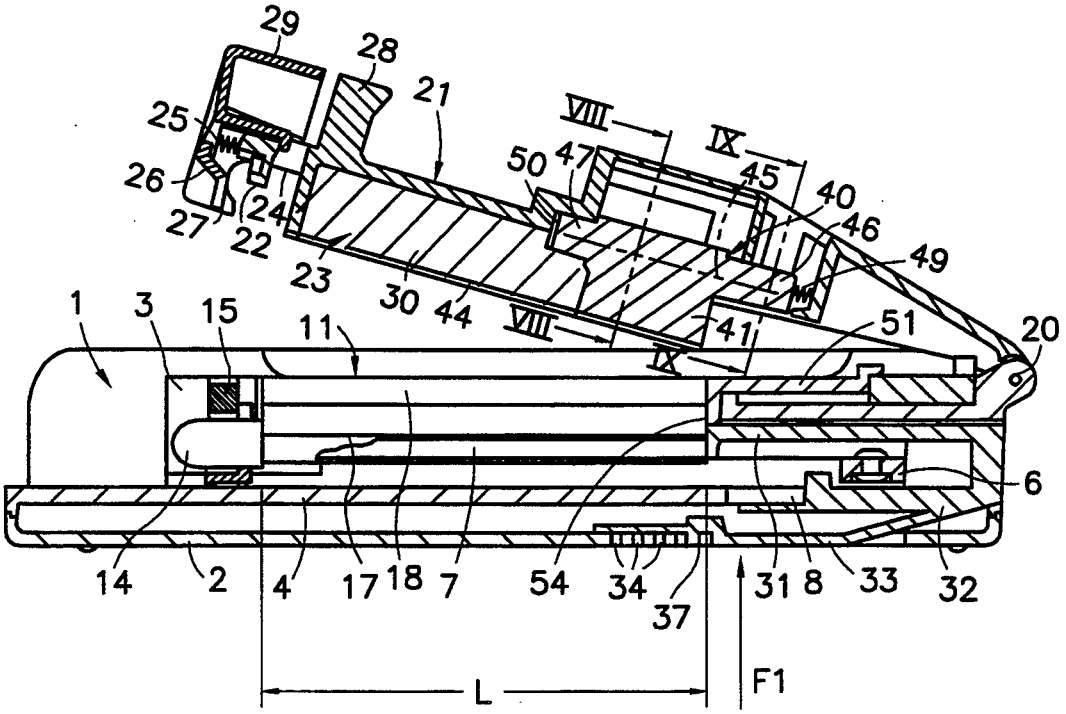
FIG. 1 shows an implementation of the device in a vertical, longitudinal cross-section through the center of the device.

The device shown in the Figures contains a housing 1 with a removable lower cover part 2; a slide 11, which is guided in a straight line in the longitudinal direction of housing 1, between side wall parts 3, 3 of the housing and on a bottom wall (i.e. wall) 4; and a cover 21, which is hinged at the rear (i.e. at the right-hand end in FIGS. 1 and 3) of slide 11 so that it can pivot about axis 20. Guide strips 13, 13 integrally formed on side walls 12 of slide 11 and projecting outwardly therefrom engage guide grooves 5, 5 provided in the lower ends of side walls 3, 3. A bushing 14, which is preferably beveled (see FIG. 3), and upon which the cigarette tube (not shown) to be filled can be placed, is located at the front end (on the left in FIGS. 1 and 3) of slide 11. In addition, the front end of slide 11 also has a clamping device, which holds the cigarette tube on the bushing during the filling process. There are numerous design possibilities for this clamping device. In the implementation shown, a clamping piece 15 of an elastic material is provided in a manner known in itself (see, for example, West German Patent No. 2,009,678). This piece is held in a recess 16 at the forward end of slide 11. To actuate clamping piece 15, a thrust piece 22 is provided at the forward end of cover 21.

In housing 1, a trough-like or groove-like tobacco holder 7 of rigid material, such as sheet metal, is permanently attached by means of, for example, a rivet 6 passing through a cross-piece of the housing. The height of tobacco holder 7 can decrease in steps or continuously toward its free end.

An elongated recess 17 in slide 11 forms a tobacco chamber. Its boundary walls 19, 19 extend downward at least to the lowermost edge areas of tobacco holder 7, and preferably even farther. It is advantageous for the thickness of boundary walls 19 to decrease toward their free edges, as a result of which a certain elasticity can be achieved in the material itself, so that it is ensured that these parts make good contact with the opposite sides of tobacco holder 7. At the top, tobacco chamber 17 widens out toward both sides to form a trough-like area 18, which makes it easier to introduce the tobacco.

On cover 21 there is a compression bar 23, the bottom of which is designed with a concavity, for example, with approximately the profile of a semi-circle, its width being approximately the same as the width of tobacco chamber 17 so that, when the cover swings down, compression bar 23 enters tobacco chamber 17 and is able to form the tobacco previously introduced into a strand.

The device has a locking assembly which makes it possible to hold cover 21 with compression bar 23 removably in place on slide 11 when the cover is in the lowered position. For this purpose, the forward end of cover 21 is designed as a guide 24 for a locking piece 26, which can be moved a limited distance in the longitudinal direction of cover 21 against the force of springs 25. Projections 27 are provided on the lateral, downward-directed shanks of the locking piece; when cover 21 is pushed down, these projections engage in recesses in the end of slide 11 and thus arrest cover 21 on slide 11. One knob 28 on the forward end of cover 21 and another knob 29 on locking piece 26 make it possible for the device to be actuated conveniently and easily, both when engaging the locking assembly and during the subsequent movement of the slide to carry out the filling process.

Figure 5:
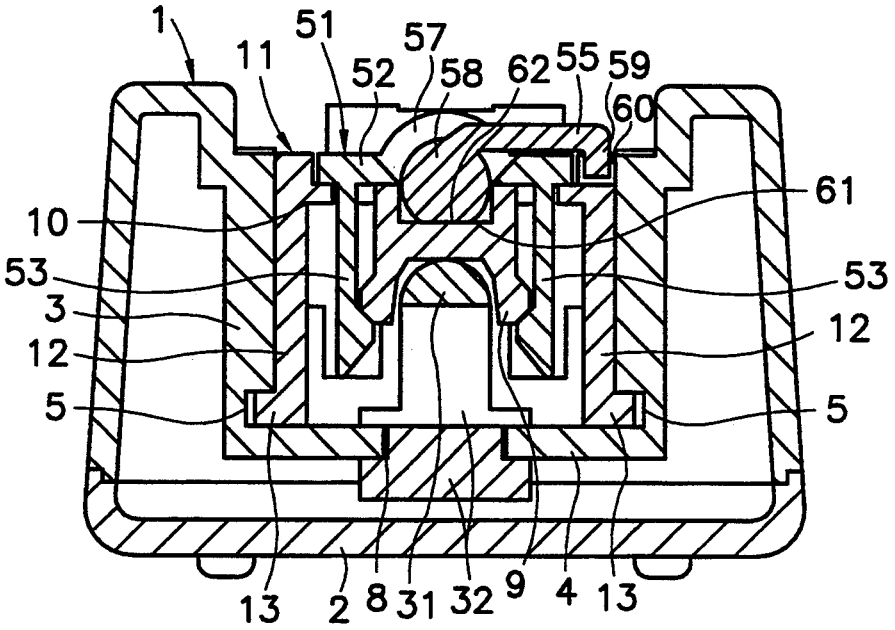
FIG. 5 shows a section along line V—V of FIG. 3 on an enlarged scale with the boundary part in the latched position.
Figure 6:
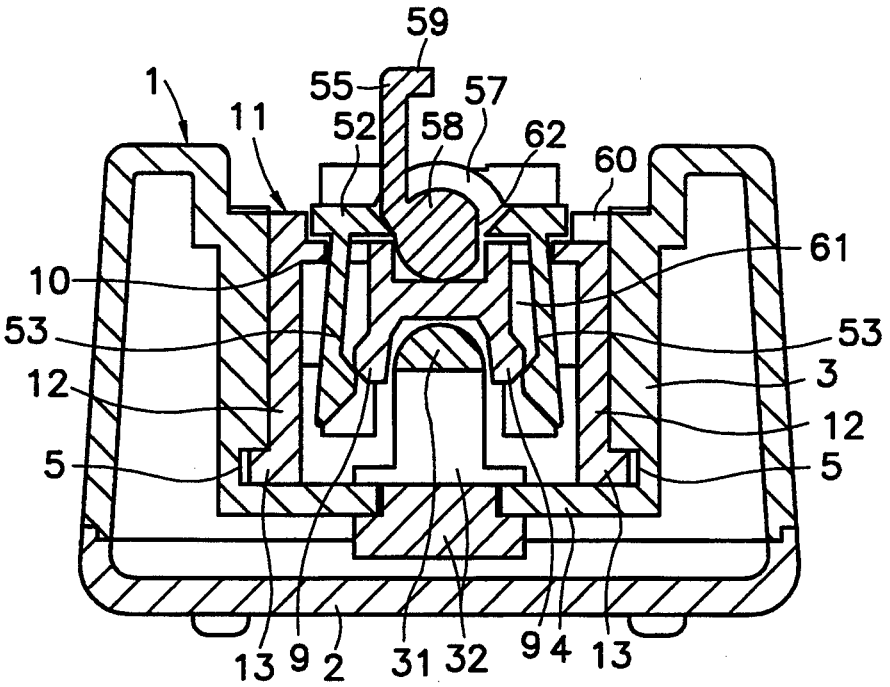
FIG. 6 shows a section corresponding to FIG. 5 with the boundary part in the unlatched position.

Reference number 31 indicates a stop, cooperating with tobacco holder 7, to define one end of the tobacco strand to be formed. When a cylindrical tobacco strand is to be formed, stop 31, which is associated with housing 1, has a circular end surface matching the profile of tobacco holder 7 and can be adjusted relative to housing 1 in the longitudinal direction of tobacco holder 7. As FIGS. 5 and 6 show, stop 31 is integrally joined to a shoulder 32 which is arranged within and is slidable along a longitudinal slot 8 in bottom wall 4; the profile of shoulder 8 is designed with lateral projections which extend beyond both the top and bottom edges of bottom wall 4 adjacent to slot 8, with the result that the shoulder is also held in the vertical direction.

Figure 2:
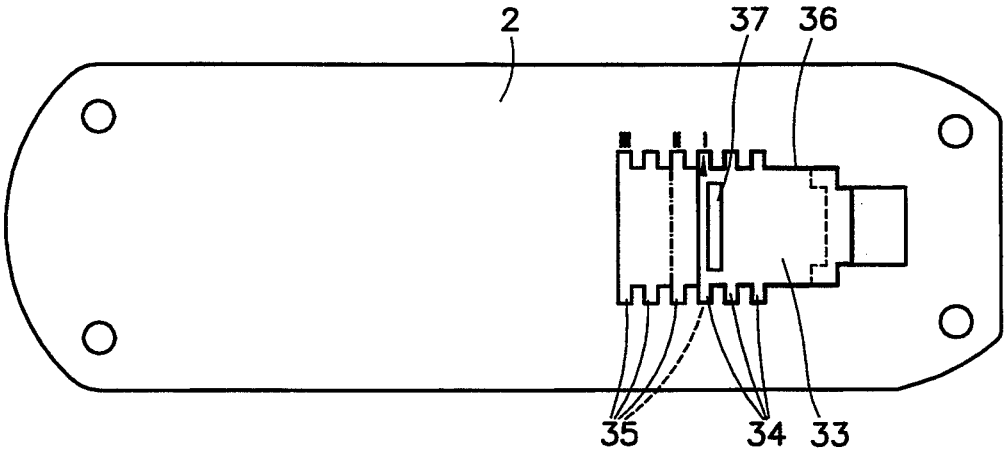
FIG. 2 shows a bottom view of the device according to FIG. 1.

Three latching positions, designated I, II, and III in FIG. 2, are provided for stop 31, corresponding to three different lengths of the tobacco strand to be formed. A plate-shaped integral locking piece 33 extends down and forward (FIG. 1) from shoulder 32 of stop 31; locking piece 33 has tooth-like projections 34 on the two opposite, parallel long sides to serve as catches. Projections 34 selectively releasably engage corresponding tooth-like recesses 35 arranged along the parallel edges of an opening 36 in lower cover part 2. Locking piece 33 is elastic and is thus able to exert a restoring force, so that it can be pressed in with a finger from the bottom of the device in the direction of arrow F1 (FIG. 1) to move projections 34 out of recesses 35. This is the "unlatched" position, in which stop 31 can be moved in the longitudinal direction to the desired position. The action of a finger on locking piece 33 is also used to move stop 31. The locking piece may be provided with a depression 37, into which, for example, a fingernail or the end of a pointed instrument can be inserted to move the stop. Once the stop has been brought into its new position, locking piece 33 is released and thus springs back due to its resilience, so that its projections 34 engage corresponding recesses 35. This becomes the new "latched" position, such as the position designated II in FIG. 2, for example. Position III can be assumed in the same way, or, by pushing in the other direction, it is possible to return the stop to position I. In accordance with these shifts, the length L of the tobacco chamber and thus the length of the tobacco strand to be formed also change.

The desired elasticity and restoring force of locking piece 33 can be achieved easily through the selection of a suitable material, especially a plastic material, and by providing the material with the appropriate cross-sectional dimensions. Instead of an elastic catch, however-,it is also possible to provide some other way of holding adjustable stop 31 in its predetermined positions, such as by means of a folding or pivoting latching element attached to the stop.

Compression bar 23 has a part 30 permanently attached in cover 21, the length of which, in this embodiment, is less than the length of the shortest tobacco strand to be formed in the device. The total length required in each case is achieved by the use of add-on sections also forming part of the compression bar, each of which can be selectively aligned with the stationary part of the compression bar. In the embodiment shown, three of these add-on compression bar sections 41, 42, 43 of different lengths are shown, which radiate substantially in the form of a star from rotatable component 40. Rotatable component 40 is supported in cover 21 and can be turned about an axis 45, which is parallel to compression surface 44 of the compression bar. The rotatable component has bearing necks 46, 47, one at each end, which are held by support parts 48 in cover 21 so that they are free to rotate.

Figure 4:
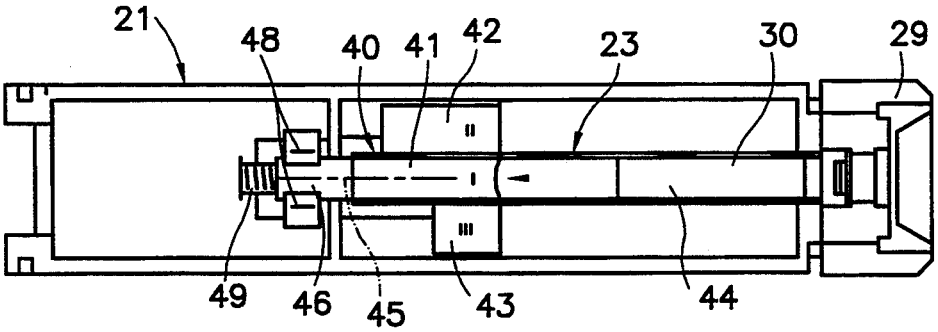
FIG. 4 shows the cover of the device looking from the bottom upward.

Each of the three sections 41, 42, 43 can selectively form an extension of stationary part 30 of the compression bar by means of the appropriate adjustment of rotatable component 40; as a result, the total length desired is obtained. These working positions of rotatable component 40 are preferably latching positions, so that unintentional movement can be prevented. In an advantageous embodiment, a compression spring 49 is provided (FIGS. 1 and 4) between bearing neck 46 and a fixed support part of the cover; this spring normally urges rotatable component 40 toward stationary part 30 of the compression bar or tries to push against an adjacent contact surface on the cover. The end of the other bearing neck 47 and a surface facing it on cover 21 or on stationary part 30 of the compression bar are provided with latching elements in the form of projections on the one side and cooperating depressions or recesses on the other or with some similar type of latching elements such as ball catches, detentes or the like. When component 40 is rotated, it undergoes a small amount of axial displacement in its support parts against the force of spring 49, until a new locking engagement occurs in the next angular position.

In the design as shown, the device is also provided with an adjustable boundary part 51 for the rear of tobacco chamber 17. Boundary part 51 is located in this case on slide 11. It has the form of a plate 52 with integral downward-pointing guide shoulders 53, 53. The plate 52 has outwardly extending portions 52*a*, 52*a* which rest on surfaces 10, 10 of slide 11. Guide shoulders 53 have hook-shaped lower edges, which rest on or grip guide parts 9 on slide 11 (FIGS. 5 and 6).

Figure 7:
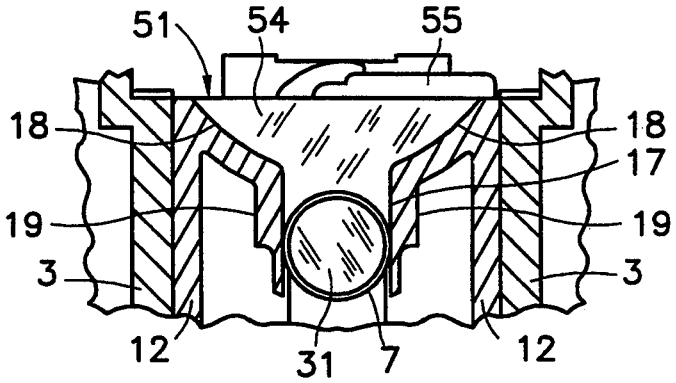
FIG. 7 shows a section along line VII—VII in FIG. 3.
Figure 8:
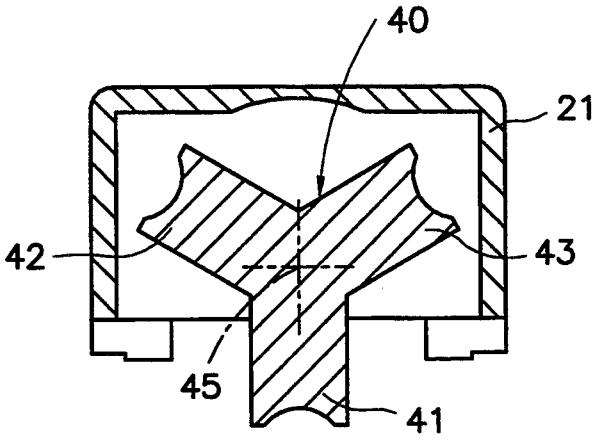
FIG. 8 shows a section along line VIII—VIII in FIG. 1.
Figure 9:
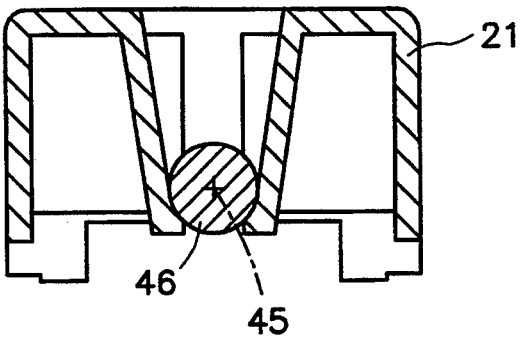
FIG. 9 shows a section along line IX—IX of FIG. 1.

As FIG. 7 shows, end wall 54 of boundary part 51 conforms to the contour of tobacco chamber 17 and trough-shaped area 18 in such a way that complete closure is obtained at the end. The lower edge of boundary part 51 is cut away in the form of a semicircle, so that its shape conforms to the profile of stop 31.

Figure 3:
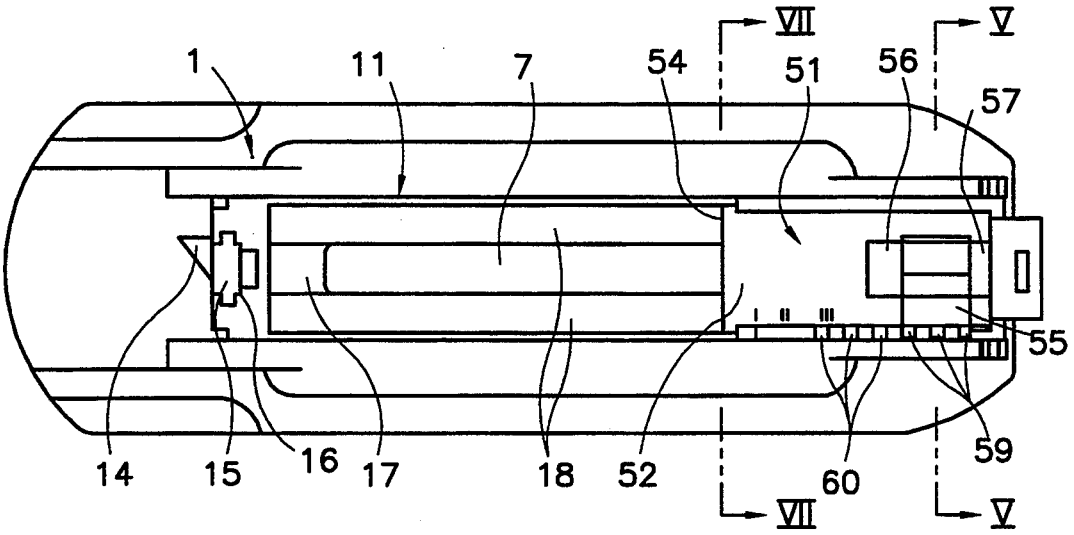
FIG. 3 shows a top view of the device according to FIG. 1 with the cover removed.

Three latching positions are provided for boundary part 51, these positions corresponding to latching positions I, II,and III of stop 31, which is how they are designated in FIG. 3. In the design shown, a pivoting catch 55 is present, which has a pin part 58, held in bearings 56, 57 of plate 52, and tooth-like projections 59 on its free edge, which can engage cooperating recesses 60 in the adjacent part of slide 11. FIGS. 1 and 3 show latching position I.

On an enlarged scale and in cross-section, FIG. 5 shows the latched state. When catch 55 is flipped up, i.e., pivoted upward, the locked state is released, and boundary part 51 can be pushed into another selected position. The side of the essentially cylindrical pin part 58 of catch 55 opposite its bearings 56, 57 is supported on a planar surface 61 of slide 11. In the latched position (FIG. 5), a flattened area 62 of pin part 58 rests on surface 61. The ends of guide shoulders 53 grip around guide parts 9. In the loose state, with catch 55 flipped up (FIG. 6), the round part of pin part 58 has rotated to the position where it engages surface 61, as a result of which plate 52 is elevated slightly, and the lower ends of guide shoulders 53 slightly spread apart and now rest more laterally on guide parts 9. In this state, boundary part 51 is easily pushed into a new position. The latching positions I, II, and III of boundary part 51 and of stop 31 are selected so that, when the two latching positions are in agreement, end wall 54 of the boundary part is flush with the end of stop 31. The section 41, 42, or 43 of the compression bar which has been positioned appropriately by means of rotatable component 40 also conforms to this alignment.

In the exemplary embodiment explained above, three predetermined adjustment positions are present. It is possible, however, to provide only two such positions, when the device is to be used for only two different formats. By the same token, the number of adjustable positions can also be greater than three.

All of the features mentioned in the above description and/or illustrated in the drawing can be considered to fall under the invention either individually or in combination, insofar as the known state of the art permits.

We claim:

1. A device for filling hollow cigarette tubes, comprising:

a housing having a tobacco chamber;

an elongated trough-like tobacco holder provided in the chamber;

a compression bar movable toward said chamber to form tobacco placed in the tobacco chamber into a strand;

stop means movable relative to said tobacco holder for defining one end of and thereby determining a length of the tobacco strand;

a bushing arranged at one end of said chamber for supporting a cigarette tube;

a slide movable relative to said housing for inserting a tobacco strand into the cigarette tube;

a length of tobacco strand being adjustable by adjusting a length of the tobacco chamber and adjusting a length of the compression bar, characterized in that the stop means is adjustable in the longitudinal direction of the tobacco holder and in that the compression bar has a stationary section and a plurality of extension sections of different lengths for selective cooperation with the stationary section to determine a length of the compression bar.

2. The device of claim 1 wherein said extension sections are rotatable about an axis which is substantially parallel to a compression surface of the compression bar.

3. The device according to claim 1 further comprising latching means providing predetermined latching positions for the adjustable stop means.

4. The device according to claim 3 further comprising a base, said stop means being slidable along said base, one of said base and stop means having projections and the other one of said base and stop means having recesses, said projections being selectively latchable into said recesses to selectively latch the stop means in one of a plurality of latching positions.

5. The device according to claim 3 characterized in that said stop means is resilient to normally urge said projection and a cooperating recess into a latching position.

6. The device according to claim 4 characterized in that said stop means is resilient to normally urge said projection and a cooperating recess into a latching position.

7. The device of claim 1 further comprising a rotatable member;

said extension sections being joined to said rotatable member to selectively align one of said extension sections with the stationary section.

8. The device according to claim 1 characterized in that means are provided to guide the stop means along said slide relative to said tobacco holder.

9. The device according to claim 1 characterized in that said rotatable member and stationary section of the compression bar are mounted upon a cover which is pivotally mounted to said slide and movable to an open position for inserting tobacco into the chamber and a closed position to form a tobacco strand.

10. The device of claim 1 characterized by adjustable boundary part means cooperating with an end of said tobacco chamber and being movable relative to said chamber to define a length of said chamber.

11. The device of claim 10 characterized by latching means for latching said boundary part means at one of a plurality of latching positions according to a desired length of said tobacco chamber.

12. The device according to claim 11 characterized in said latching means comprises at least one projection provided on said boundary part means and a plurality of recesses provided on said slide and being spaced apart in an adjusting direction of the boundary part means whereby a latching position of the boundary part means is selected according to the recess engaging said projection.

13. The device according to claim 11 characterized in said latching means comprises a plurality of recesses provided on said boundary part means and at least one projection provided on said slide, said recesses being spaced apart in an adjusting direction whereby a latching position of the boundary part means is selected according to the recess engaging the projection.

14. The device of claim 12 characterized in that said latch means further comprises swingable catch means for releasably latching said boundary part means relative to said slide.

15. The device according claim 8 characterized in that said boundary part means is located on said slide.

16. The device of claim 11 wherein said boundary part means includes a wall forming a boundary at one end of said tobacco chamber and being arranged adjacent to said stop means.

17. The device of claim 14 wherein said swingable catch means further comprises a pivoting member having a flat portion and a rounded portion;

said pivoting member slidably engaging a stationary part, said latching means being in the latched position when said flat surface engages said stationary part and being lifted when the curved portion of said pivoting member engages said stationary part to facilitate sliding movement of said boundary part means.

* * * * *